US009786466B2

(12) United States Patent
Kang et al.

(10) Patent No.: US 9,786,466 B2
(45) Date of Patent: Oct. 10, 2017

(54) MICRO X-RAY TUBE

(71) Applicant: ELECTRONICS AND TELECOMMUNICATIONS RESEARCH INSTITUTE, Daejeon (KR)

(72) Inventors: Jun Tae Kang, Daejeon (KR); Yoon Ho Song, Daejeon (KR); Jin Woo Jeong, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 87 days.

(21) Appl. No.: 14/944,022

(22) Filed: Nov. 17, 2015

(65) Prior Publication Data

US 2016/0148778 A1 May 26, 2016

(30) Foreign Application Priority Data

Nov. 21, 2014 (KR) ..... 10-2014-0163861
Sep. 9, 2015 (KR) ..... 10-2015-0127843

(51) Int. Cl.

| | |
|---|---|
| ***H01J 1/304*** | (2006.01) |
| ***H01J 35/16*** | (2006.01) |
| ***G21K 1/10*** | (2006.01) |
| *H01J 35/06* | (2006.01) |

(52) U.S. Cl.

CPC ..... *H01J 35/16* (2013.01); *G21K 1/10* (2013.01); *H01J 35/065* (2013.01)

(58) Field of Classification Search

CPC .. H01J 35/08; H01J 35/14; H01J 35/06; H01J 35/02; H01J 2235/088; H01J 2235/165; H01J 35/04; H01J 35/00; H01J 35/20; H01J 19/42; H01J 2229/4827; H01J 9/18; H01J 9/244

USPC ..... 378/119, 121, 134, 137

See application file for complete search history.

(56) References Cited

U.S. PATENT DOCUMENTS

| | | | | |
|---|---|---|---|---|
| 8,873,715 | B2 * | 10/2014 | Ogata | H01J 35/065 378/112 |
| 9,058,958 | B2 * | 6/2015 | Aoki | H01J 35/04 |
| 2011/0188635 | A1 | 8/2011 | Cho et al. | |
| 2014/0161232 | A1 | 6/2014 | Jeong et al. | |
| 2014/0362971 | A1 | 12/2014 | Lee et al. | |

FOREIGN PATENT DOCUMENTS

| | | | |
|---|---|---|---|
| KR | 10-2011-0055991 | A | 5/2011 |
| KR | 10-2011-0090357 | A | 8/2011 |
| KR | 10-2013-0084257 | A | 7/2013 |
| KR | 10-2014-0013139 | A | 2/2014 |

* cited by examiner

*Primary Examiner* — Don Wong

(57) ABSTRACT

The present disclosure may provide a micro X-ray tube with a filter tube to filter X-rays and at the same time to serve as an insulator. For this, the X-ray tube may include a filter tube between a second electrode and a gate electrode, hence separating from each other. The second electrode may have a target and the gate electrode may accelerate an electron-beam to collide with the target. The filter tube includes an alumina ($Al_2O_3$). The target is inclined to allow the X-rays to be directed toward the filter tube.

17 Claims, 11 Drawing Sheets

MICRO X-RAY TUBE

CROSS-REFERENCE TO RELATED APPLICATION

The present application claims priority to Korean patent application number 10-2014-0163861 filed on Nov. 21, 2014 and 10-2015-0127843 filed on Sep. 9, 2015, the entire disclosure of which is incorporated herein in its entirety by reference.

BACKGROUND

Field

Embodiments of the present disclosure are directed to a micro X-ray tube.

Related Arts

Generally, a diagnostic X-ray system such as a CT (Computed Tomography) may have filter mounted therein. The filter may serve to reduce X-rays with low energies because such X-rays may be useless in an imaging process. Thus, the filter may serve to minimize X-ray exposure of a subject. Further, the filter may act to enable uniformity in X-ray emissions to improve an acquired image quality. In a conventional X-ray tube, X-rays may be emitted through a glass tube or beryllium window, and the x-rays may be filtered by a separate metal plate, for example, made of an aluminum material.

FIG. 1 is a conceptional view of a conventional triode-type field emission X-ray tube and a filter mounted therein. In FIG. 1, the X-ray tube includes a cathode 10, a gate electrode 20, an anode 30, and insulators 41, and 42. The tube is further equipped with a filter 50. The cathode 10 is provided with an emitter. The gate electrode 20 applies an electrical field to the emitter. The anode 30 accelerates emitted electron-beams which in turn, collide with a target 31, resulting in generations of X-rays. The X-rays passes and are filtered by the filter 50. The insulators 41 and 42 insulate the electrodes respectively.

Such a triode-type field emission X-ray tube may facilitate an X-ray radiation-amount adjustment via a separation between gate and anode voltages, where the gate voltage adjusts an electron-beam amount and the anode voltage establishes electron-beam energy.

However, in the micro X-ray tube as in FIG. 1, due to a high voltage applied to the anode, there may disadvantageously be generated an abnormal field emission at a joint 60 between the gate electrode 20 and the insulator 42.

SUMMARY

The present disclosure may, in one aim thereof, provide a micro X-ray tube with a filter tube.

The present disclosure may, in one aim thereof, provide a micro X-ray tube with reduction of abnormal field emissions at a joint between a filter tube and a gate electrode.

An exemplary embodiment provides a micro X-ray tube, comprising: a first electrode emitting an electron-beam; a gate electrode accelerating the electron-beam; a second electrode with a target configured to collide with the accelerated beam; an insulation tube configured to electrically insulate between the first electrode and the gate electrode; and a filter tube between the second electrode and the gate electrode and filtering X-rays.

The filter tube may include an alumina $Al_2O_3$. The target may be inclined so that the X-rays generated by collision between the target and the electron-beam are directed toward the filter tube.

The first electrode may have an emitter emitting the electron-beam. The first electrode may be a cathode.

The gate electrode may be hollow so that the electron-beam from the first electrode may pass through inside the gate electrode and reach the target.

The second electrode may be an anode.

In one embodiment, the filter tube may have an inner surface defining a hollow portion of the filter tube. The target may face and incline toward the inner surface of the filter tube.

In one embodiment, the second electrode may have a flange and a body extending from the flange toward the gate electrode. The body of the second electrode may have the target at one end thereof. The hollow portion of the filter tube may receive at least a portion of the body.

In one embodiment, the gate electrode may be a tube-shaped, and secured between the insulation tube and the filter tube.

Another exemplary embodiment provides a micro X-ray tube, comprising: a first electrode emitting an electron-beam; a gate electrode accelerating the electron-beam; a second electrode with a target configured to collide with the accelerated beam; an insulation tube configured to electrically insulate between the first electrode and the gate electrode; and a filter tube between the second electrode and the gate electrode and filtering X-rays, wherein the gate electrode comprises a gate electrode flange inserted between the insulation tube and the filter tube, and a gate electrode body extending along inside the filter tube from the gate electrode flange toward the second electrode.

The filter tube may include an alumina $Al_2O_3$. The target may be inclined so that the X-rays generated by collision between the target and the electron-beam are directed toward the filter tube.

The first electrode may have an emitter emitting the electron-beam. The first electrode may be a cathode.

The gate electrode may be hollow so that the electron-beam from the first electrode may pass through inside the gate electrode and reach the target.

The second electrode may be an anode.

In one embodiment, the insulation tube may be between the first electrode and the gate electrode flange.

In one embodiment, the gate electrode flange may be spaced apart from the first electrode.

In one embodiment, the first electrode may have an emitter-side end having a diameter larger than a diameter of the hollow portion of the gate electrode but smaller than an inner diameter of the insulation tube.

In one embodiment, the filter tube may include a step portion engaged with the gate electrode flange. The gate electrode flange may contact with the step portion of the filter tube.

In one embodiment, the step portion of the filter tube may include a first surface extending inwardly from an outer surface of the filter tube and a second surface extending in a longitudinal direction of the filter tube from the first surface toward the first electrode. The second surface of the filter tube may meet a free end of the filter tube. The gate electrode flange may contact with the first surface.

In one embodiment, the gate electrode flange may have an extension wall extending from an outer circumference of the electrode flange toward the second electrode and surrounding the second surface of the step portion.

In one embodiment, the extension wall may be contact with the first surface of the step portion. The extension wall may be spaced from the second surface of the step portion and from the free end of the filter tube.

In one embodiment, the gate electrode may be tube-shaped and secured between the insulation tube and the filter tube.

In one embodiment, the filter tube may have an inner surface defining a hollow portion of the filter tube. The gate electrode body has an outer surface facing and being spaced from the inner surface of the filter tube.

In one embodiment, an outer surface of the gate electrode body may have a step between a first body portion and the second body portion so that a gap between the first body portion and the inner surface of the filter tube may be smaller than a gap between the second body portion and the inner surface of the filter tube. The first body portion may extend from the gate electrode flange toward the second electrode. The second body portion may connect with the first body portion via the step of the gate electrode body and extend toward the second electrode.

In one embodiment, the hollow portion of the gate electrode may have a single diameter in a longitudinal direction thereof. The hollow portion may run through entirely the gate electrode flange, the first body portion and the second body portion.

In one embodiment, the gate electrode body may have a free end at the second electrode side. The free end may have a rounded surface.

Via one aspect of the present disclosure, a simple structure of the X-ray tube may be achieved due to the insulator functioning as an x-ray filter.

Via one aspect of the present disclosure, abnormal electric fields generated at the joint between the insulator and the gate electrode could not be emitted out of the joint.

BRIEF DESCRIPTION OF DRAWINGS

A more complete appreciation of the present invention, and many of the attendant features and aspects thereof, will become more readily apparent as the invention becomes better understood by reference to the following detailed description when considered in conjunction with the accompanying drawings, in which.

DETAILED DESCRIPTIONS

Figure 1:
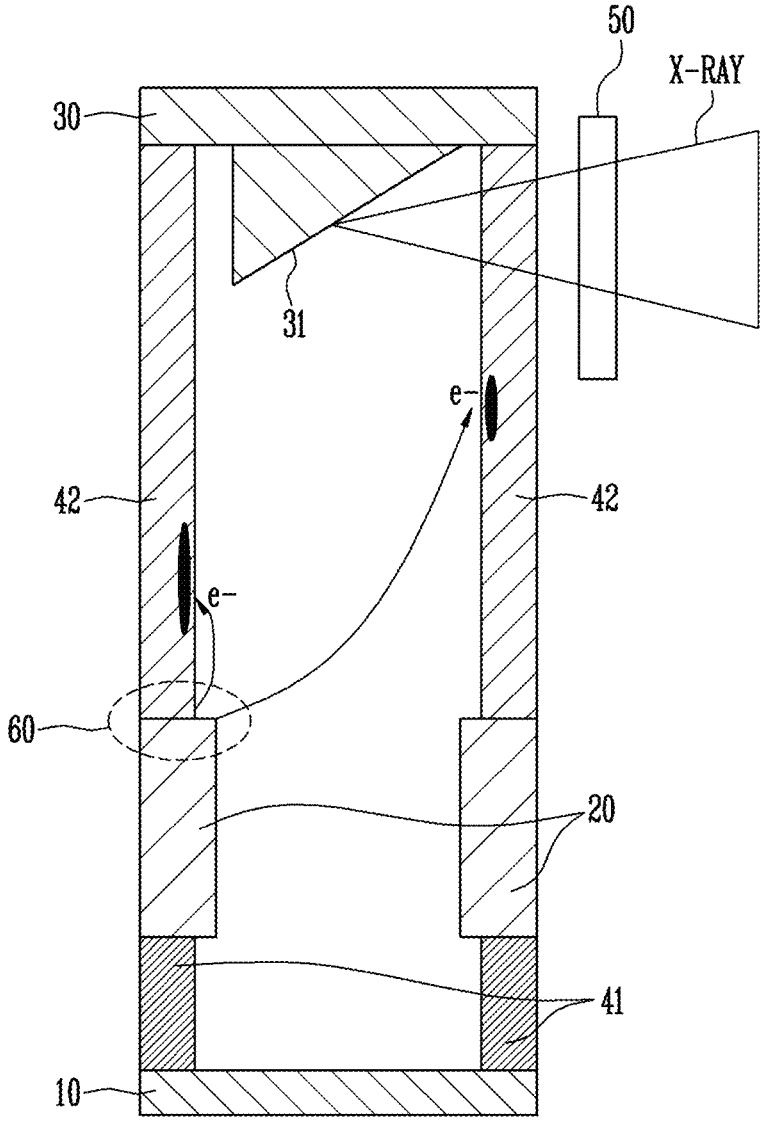
FIG. 1 is a conceptional view of a conventional triode-type field emission X-ray tube and a filter mounted thereon.

Examples of various embodiments are illustrated in the accompanying drawings and described further below. It will be understood that the discussion herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Hereinafter, the various embodiments of the present disclosure will be described in details with reference to attached drawings.

Figure 2:
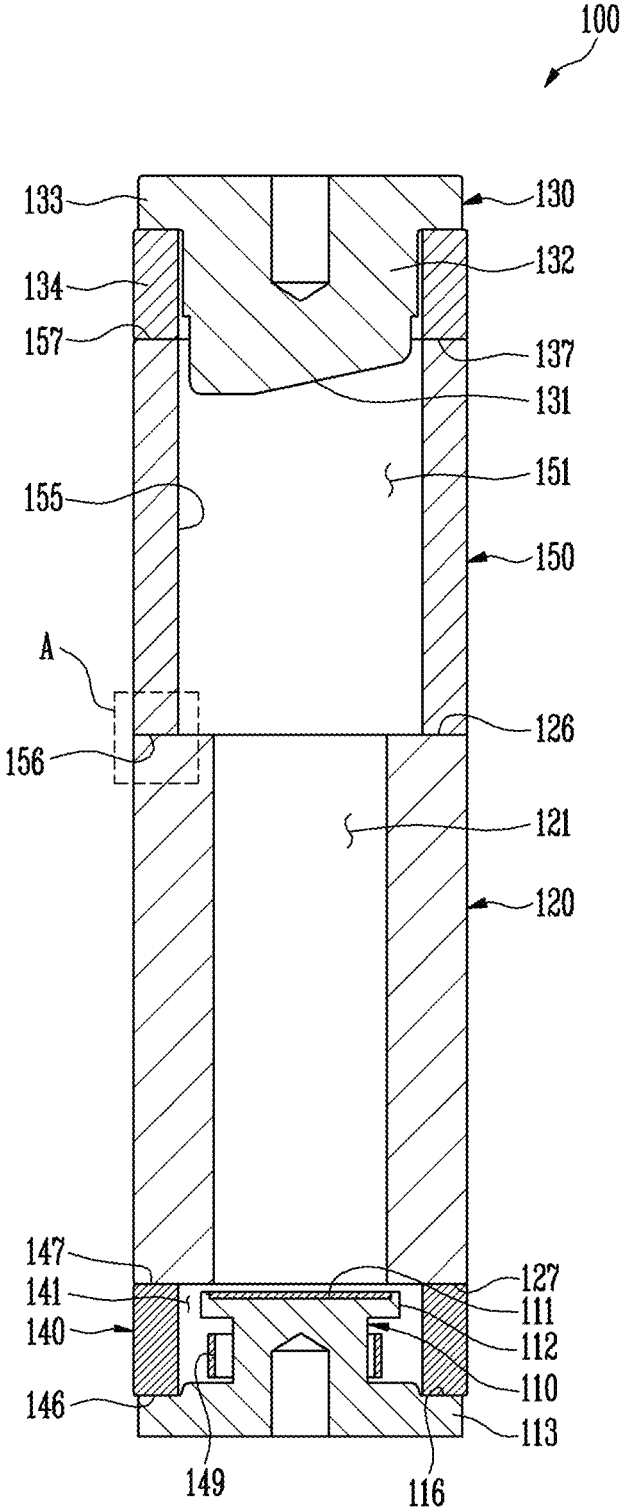
FIG. 2 is a cross-sectional view of a micro X-ray tube in a longitudinal direction thereof in accordance with one embodiment of the present disclosure.

FIG. 2 is a cross-sectional view of a micro X-ray tube in a longitudinal direction thereof in accordance with one embodiment of the present disclosure. A micro X-ray tube 100 in accordance with one embodiment of the present disclosure may have a substantially-cylindrical appearance in a whole. In FIG. 2, a cross-section of the micro X-ray tube 100 is taken in a longitudinal direction, in other words, axial direction of a cylinder structure.

The micro X-ray tube 100 in accordance with one embodiment of the present disclosure may be embodied in a field emission X-ray tube, which may include a first electrode 110, a gate electrode 120, a second electrode 130, an insulation tube 140 to insulate between the first electrode and the gate electrode, and a filter tube 150 disposed between the second electrode and the gate electrode.

The first electrode 110 may be provided with an emitter 111 to emit electron-beams. The first electrode 110 may be surrounded with and fixed by the insulation tube 140. The first electrode 110 may have a first electrode flange 113 engaged with one end 146 of the insulation tube 140. The first electrode 110 may be formed in a cylindrical conductive member and may emit electron-beams via the emitter 111.

The first electrode 110 may include a body disposed in a hollow portion 141 of the insulation tube 140 and extending from the first electrode flange 113 toward the gate electrode 120. The body of the first electrode 110 may have an emitter fixture 112 facing the gate electrode 120. The emitter 111 may mount on the emitter fixture 112.

The body of the first electrode 110 may be generally cylindrical. The emitter fixture 112 may be generally cylindrical. The emitter fixture 112 may have a larger diameter than that of the body of the first electrode 110, and have a smaller diameter than that of the hollow portion 141 of the insulation tube 140. However, the present disclosure is not limited thereto.

The insulation tube 140 may be configured to be disposed between and thus insulate the gate electrode 120 from the first electrode 110. The insulation tube 140 may have the hollow portion 141 therein. The insulation tube 140 may have one end 146 engaged with a surface 116 of the first electrode flange 113, and the other end 147 engaged with an end 127 of the gate electrode 120. The one end 146 of the insulation tub 140 is opposite to the other end 147 of the insulation tube 140.

The end 127 of the gate electrode 120 and the first electrode flange 113 may be spaced apart and thus electrically insulated from each other via the insulation tube 140.

The insulation tube 140 may surround the body of the first electrode 110 in a spaced manner therefrom. The insulation tube 140 may further include a getter 149 disposed between the emitter fixture 112 and the first electrode flange 113 and partially surrounding the body of the first electrode 110. The getter 149 may be received in the hollow portion 141 of the insulation tube 140 and be positioned between the body of the first electrode 110 and the insulation tube 140. The getter 149 may refer to a pump having a gas absorption material to maintain a vacuum state in the tube.

The gate electrode 120 may refer to an electrode tube having a hallow portion therein and extending toward the first electrode 110 and the second electrode 130. In other words, the gate electrode 120 may have both opposing opened ends. One open end faces the emitter fixture 112, while the other open end faces the target 131 of the second electrode 130. The gate electrode 120 may be fixed between the insulation tube 140 and the filter tube 150.

The gate electrode 120 may have a hollow portion 121 formed therein. Thus, the electron-beams emitted from the first electrode 110 may pass through the hollow portion 121 of the gate electrode 120 and reach the target 131 of the second electrode 130. The gate electrode 120 may accelerate the electron-beams emitted from the first electrode 110.

The gate electrode 120 may have the one end 127 engaged with the other end 147 of the insulation tube 140, and the other end 126 engaged with the end 156 of the filter tube 150. The one end 127 of the gate electrode 120 is opposite to the other end 126 of the gate electrode 120. The hollow portion 121 of the gate electrode 120 may have a smaller diameter than that of the emitter fixture 112 of the first electrode 110. The one end 127 of the gate electrode 120 may be spaced from the emitter fixture 112 of the first electrode 110.

The second electrode 130 may have a generally cylindrical shape. The second electrode 130 may have a target 131 to be collided with the electron-beams accelerated via the gate electrode 120. The second electrode 130 may have a second electrode flange 133 to fix the second electrode, and a second electrode body 132 extending from the second electrode flange 133 toward the gate electrode 120 via the hollow portion 151 of the filter tube 150.

The second electrode 130 may further include a conductive tube 134 having one end engaged with the second electrode flange 133, and the other end 137 engaged with the other end 157 of the filter tube 150. The conductive tube 134 may surround a portion of the second electrode body 132, and thus have the same thickness and/or shape as those of the filter tube 150. It may be appreciated that, for the second electrode, the conductive tube 134 may not be configured as shown in the figure. For example, the conductive tube 134 may be formed in a monolithic manner with the second electrode flange 133. For another instance, the conductive tube 134 may not be present. In a latter case, the second electrode flange 133 may be directly engaged with the other end 157 of the filter tube 150.

The second electrode body 132 may extend beyond a distal end of the conductive tube 134, so that a portion where the target 131 is mounted on may be disposed in the hollow portion 151 of the filter tube 150.

The second electrode body 132 may have an end facing the gate electrode 120 and mounting the target 131 thereon. The target 131 may be spaced from the gate electrode 120.

The target 131 may collide with the electron-beams passing through the gate electrode 120. The target 131 may have an inclined surface configured to allow X-rays generated by collision between the target and the electron-beams to be directed toward the filter tube. The X-rays from the target 131 may be transmitted through the filter tube 150 and emitted out of the x-ray tube 100.

The first electrode 110 may be a cathode, while the second electrode 130 may an anode in one embodiment.

The filter tube 150 may refer to a hollowed cylindrical tube having a predetermined thickness to allow for filtrations of the X-rays from the target 131. The filter tube 150 may be disposed between the second electrode 130 and the gate electrode 120 so that the second electrode 130 is separated from the gate electrode 120.

The hollow portion 151 of the filter tube 150 may have a larger diameter than that of the hollow portion 121 of the gate electrode 120. The filter tube 150 may have an inner surface 155 to define the hollow portion 151. The filter tube 150 may receive the portion of the second electrode 130 with the target 131 in the hollow portion 151 thereof. The filter tube 150 may extend beyond the target 131 toward the gate electrode 120. The X-rays from the target 131 may emit toward the inner surface 155 of the filter tube 150.

The filter tube 150 may be made of an alumina $Al_2O_3$ to filer the X-rays. Further, since the alumina may be electrically insulating, the filter tube 150 may insulate the gate electrode 120 from the second electrode 130.

Figure 3:
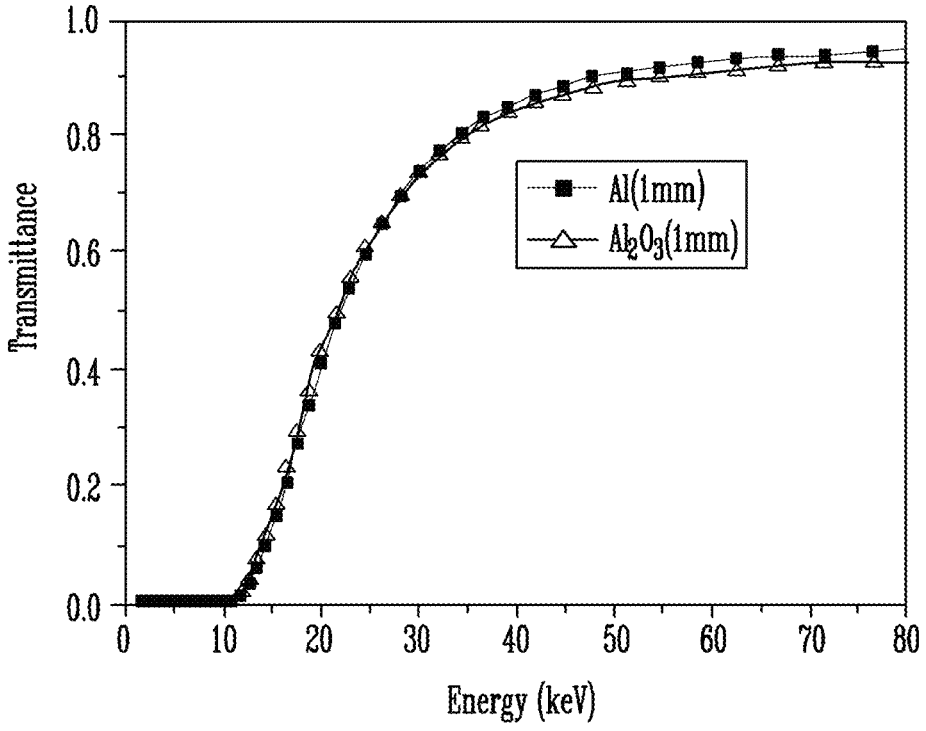
FIG. 3 is a graph to illustrate X-ray transmittance comparisons between an aluminum with a thickness 1 mm and an alumina with a thickness 1 mm.

FIG. 3 is a graph to illustrate X-ray transmittance comparisons between an aluminum Al with a thickness 1 mm and an alumina $Al_2O_3$ with a thickness 1 mm as filter tubes 150 respectively, provided that the filter tube has a 1 mm thick wall. In FIG. 3, an x axis may refer to an X-ray energy while a y axis may refer to an X-ray transmittance. The X-ray transmittance=1.0 may correspond to 100% of X-ray passing through the tube, while the X-ray transmittance=0.0 may correspond to zero % of X-ray passing through the tube.

As described above with connection to FIG. 1, X-rays emitted from the conventional X-ray tube are filtered using the separate filter 50 which is made of the aluminum Al. As seen in FIG. 3, the transmittance of the X-rays from the target 131 through the 1 mm thick filter tube 150 (FIG. 2) may be substantially similar to the transmittance of the X-rays from the target through the 1 mm thick aluminum filter since mass attenuation coefficients of the aluminum and alumina are substantially similar to each other. Thus, using the alumina material forming the filter tube 150 receiving therein the target 131 in the embodiment of FIG. 2, insulating between the second electrode and the gate electrode and dispensing with the need for the separate aluminum filter could be realized at a single stroke. This could result in a simple configuration for filtering the X-rays.

Figure 4:
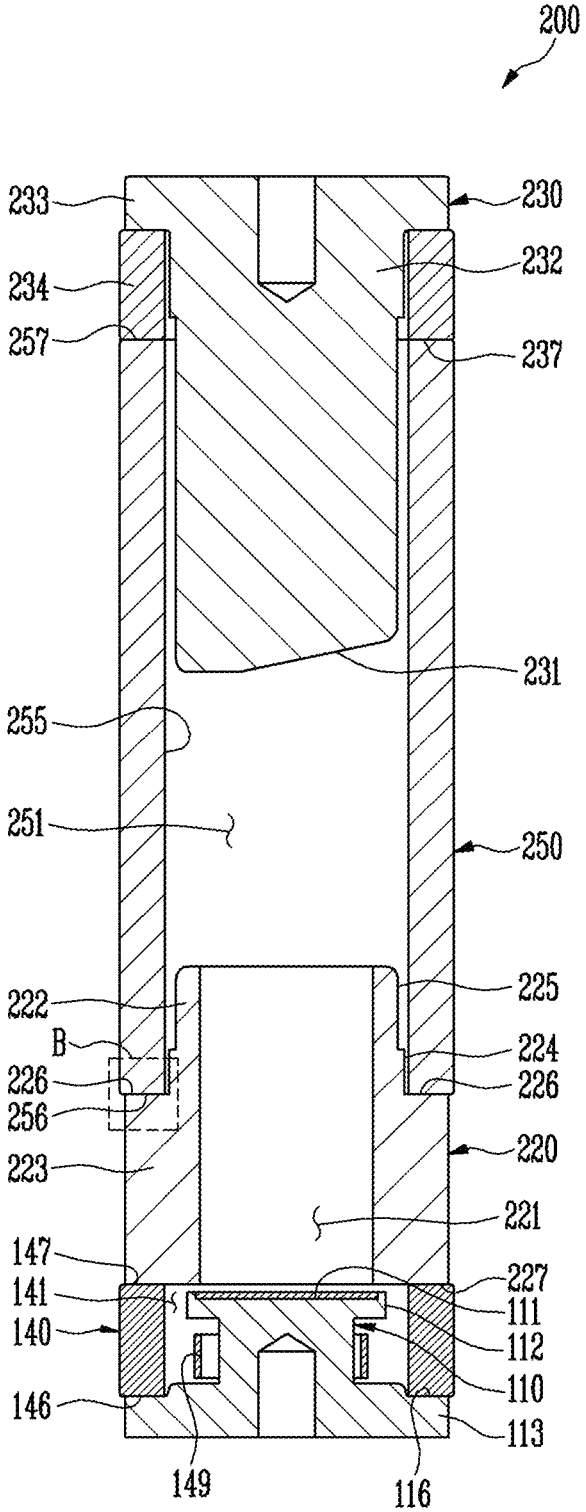
FIG. 4 is a cross-sectional view of another embodiment of the present disclosure.
Figure 5:
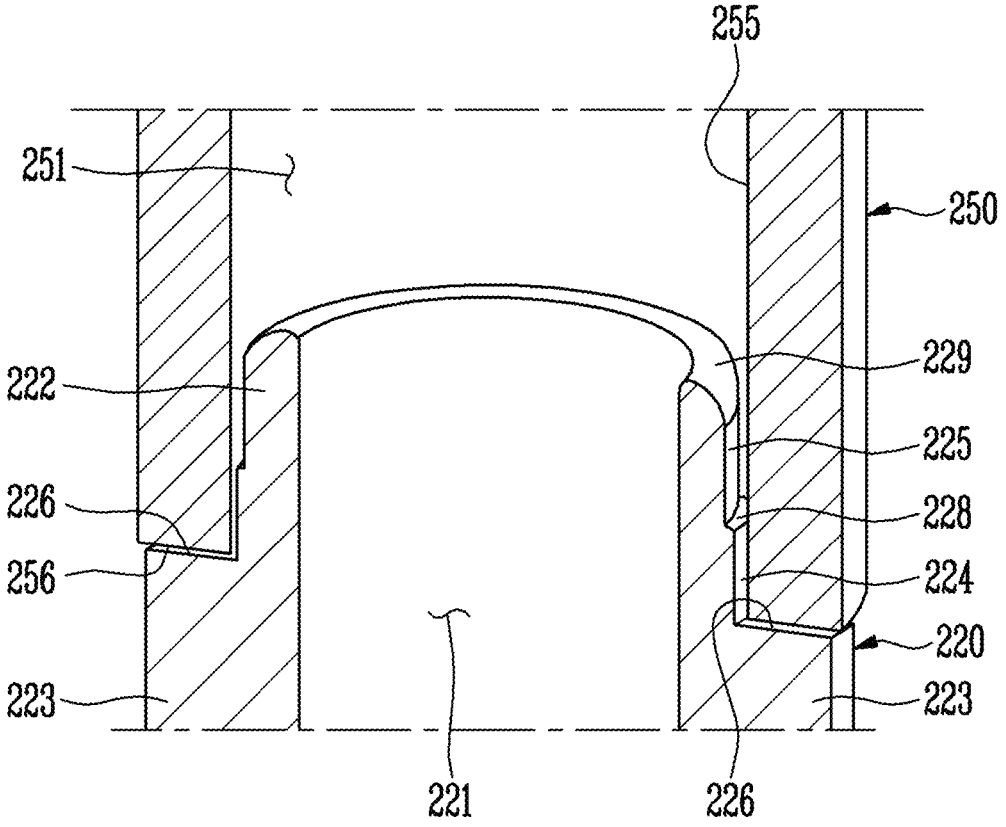
FIG. 5 is a partially enlarged cross-sectional view of the embodiment of FIG. 4.

FIG. 4 is a cross-sectional view of another embodiment of the present disclosure. FIG. 5 is an enlarged cross-sectional view of a certain portion in the embodiment of FIG. 4. The embodiment of FIG. 4 may be one variation of the gate electrode in the embodiment of FIG. 2. A micro X-ray tube 200 in this embodiment may be implemented in a field emission X-ray tube, which may include a first electrode 110, gate electrode 220, second electrode 230, insulation tube 140 to insulate between the first electrode and the gate electrode, and the filter tube 250 disposed between the second electrode and the gate electrode and filtering the X-rays.

The first electrode 110 and the insulation tube 140 may be identical with those in FIG. 2 in terms of their configurations and thus may be assigned the same labels as in FIG. 2, and detailed descriptions of which may be omitted.

The filter tube 250 may be disposed between the second electrode 230 and the gate electrode 220 to space therebetween. The filter tube 250 may have an inner surface 255 defining a hollow portion 251 of the filter tube 250. The filter tube 250 may be a cylindrical tube configured to receive the target 231 so that the X-rays from the target 231 of the second electrode 230 may be directed toward the inner surface 255. The filter tube 250 may be made of an alumina.

The second electrode 230 may be generally cylindrical and may have the target 231 to collide with the electron-beams accelerated by the gate electrode 220. The second electrode 230 may include a second electrode flange 233 to secure the second electrode, and a second electrode body 232 extending from the second electrode flange 233 toward the gate electrode 220 via the hollow portion 251 of the filter tube 250.

The second electrode 230 may further include a separate conductive tube 234 as in the embodiment of FIG. 2. The conductive tube 234 may have one end engaged with the second electrode flange 233 and the other end 237 engaged with the other end of the filter tube 250. The conductive tube 234 may partially surround the second electrode body 232 and may have the same thickness and/or shape of the filter tube 250. It may be noted that as in FIG. 2, the conductive tube 234 may be integrated with the second electrode flange 233 or may be omitted.

The second electrode body 232 may extend beyond the conductive tube 234 so that a portion with the target 231 may be disposed in the hollow portion 251 of the filter tube 250. The second electrode body 232 may have the target 231 at the end facing the gate electrode 220. The filter tube 250 may extend toward the gate electrode 220 beyond the target 231 to space the target 231 and the gate electrode 220 from each other.

The target 231 may have an inclined surface so that X-rays generated by collisions between the electron-beam and the target 231 may be directed to the inner surface 255 of the filter tube 250. The X-rays generated from the target 231 may transmit the filter tube 250 and emitted out of the X-ray tube 200.

The gate electrode 220 may have a hollow portion 221 formed therein through which electron-beams from the first electrode 110 pass. The gate electrode 220 may have a gate electrode flange 223 secured between the insulation tube 140 and the filter tube 250. Further, the gate electrode 220 may have a gate electrode body 222 extending from the gate electrode flange 223 via the hollow portion 251 of the filter tube 250 toward the second electrode 230. The hollow portion 221 of the gate electrode 220 may extend in a longitudinal direction thereof and with a single diameter to fully pass through the gate electrode flange 223 and the gate electrode body 222.

The gate electrode flange 223 may be configured to open to the emitter fixture 112 of the first electrode, and be spaced from the emitter fixture 112 and from the emitter 111. The gate electrode flange 223 may have a first side 226 engaged with one end 256 of the filter tube and a second side 227 engaged with the other end 147 of the insulation tube.

The gate electrode body 222 may have a free end 229 opening toward the second electrode 230, the free end 229 opposing the gate electrode flange 223 in a longitudinal direction.

The gate electrode body 222 may be received in the hollow portion 251 of the filter tube to be surrounded with the filter tube 250 while being spaced from the inner surface 255 of the filter tube. The inner surface 255 of the filter tube may define a diameter of the hollow portion 251 of the filter tube.

The gate electrode body 222 may have a step on a surface facing the inner surface 255 of the filter tube. To be specific, the gate electrode body 222 may have a first body portion with an outer surface facing the inner surface 255 of the filter tube, and a second body portion with an outer surface facing the inner surface 255 of the filter tube. The outer surface of the first body portion is closer to the inner surface 255 of the filter tube than that of the second body portion.

FIG. 5 is an enlarged cross-sectional view of the gate electrode body 222 and a filter tube 250 surrounding the same. Referring to FIG. 5, an "outer surface" of the gate electrode body 222 may be defined as a surface facing the inner surface 255 of the filter tube. As seen from FIG. 5, the outer surface of the gate electrode body 222 may be configured such that a portion of the outer surface at the gate electrode flange 223 side may be closer to the inner surface 255 than a portion of the outer surface at the second electrode 230 side.

Specifically, the outer surface of the gate electrode body 222 may include first and second portions 224 and 225, and a middle portion 228 between the first and second portions 224, 225. The first portion 224 may extend from the first side 226 of the gate electrode flange 223 toward the second electrode 230 in a longitudinal direction. The middle portion 228 may extend inwardly from the first portion 224 to the second portion 225. The second portion 225 may extend from the middle portion 228 toward the second electrode 230 in a longitudinal direction. The first portion 224 may be closer to the inner surface 255 than the second portion 225. The second portion 225 may extend to the free end 229 of the gate electrode body 222.

In this way, the first and second portions 224 and 225 of the gate electrode body 222 may be divided to sandwich the middle portion 228.

Via the middle portion 228, the second portion 225 of the gate electrode body may be spaced in a larger distance from the inner surface 255 than the first portion 224 of the gate electrode body.

Due to the fact that the first portion 224 of the gate electrode body may be closer to the inner surface 255 than the second portion 225, in an assembly process, one end 156 of the filter tube 250 may be guided to encounter the first side 226 of the gate electrode flange 223. In the assembled state, the second portion 225 of the gate electrode body may be spaced in a larger distance from the inner surface 255 than the first portion 224 of the gate electrode body.

Via the above configuration where there is formed a gap between the gate electrode body and the filter tube, there may occur reduction of an electrical field between the gate electrode and the filter tube. Additionally, via the configuration where the gate electrode body 222 at the gate electrode flange 223 side may be relatively closer to the inner surface 255 of the filter tube 250, it may facilitate the assembling process between the filter tube 250 and the gate electrode 220.

In this embodiment, the free end 229 of the gate electrode body may be configured to extend from the second portion to an opened top facing the second electrode 230, and have a rounded surface appearance to generally face the inner surface 255 of the filter tube. This rounded surface of the free end 229 may lead to a suppression of field concentration into the free end 229.

Figure 6:
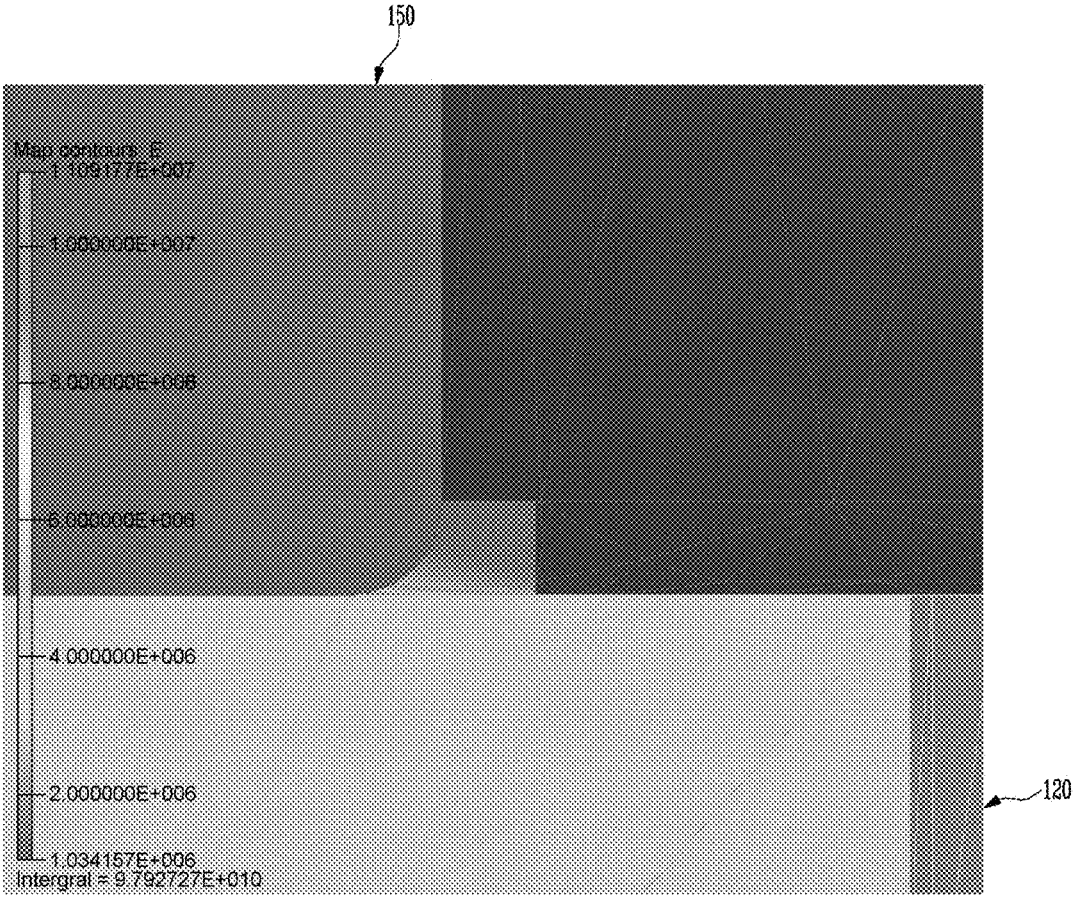
FIG. 6 illustrates an electric field at a portion A of the embodiment in FIG. 2.
Figure 7:
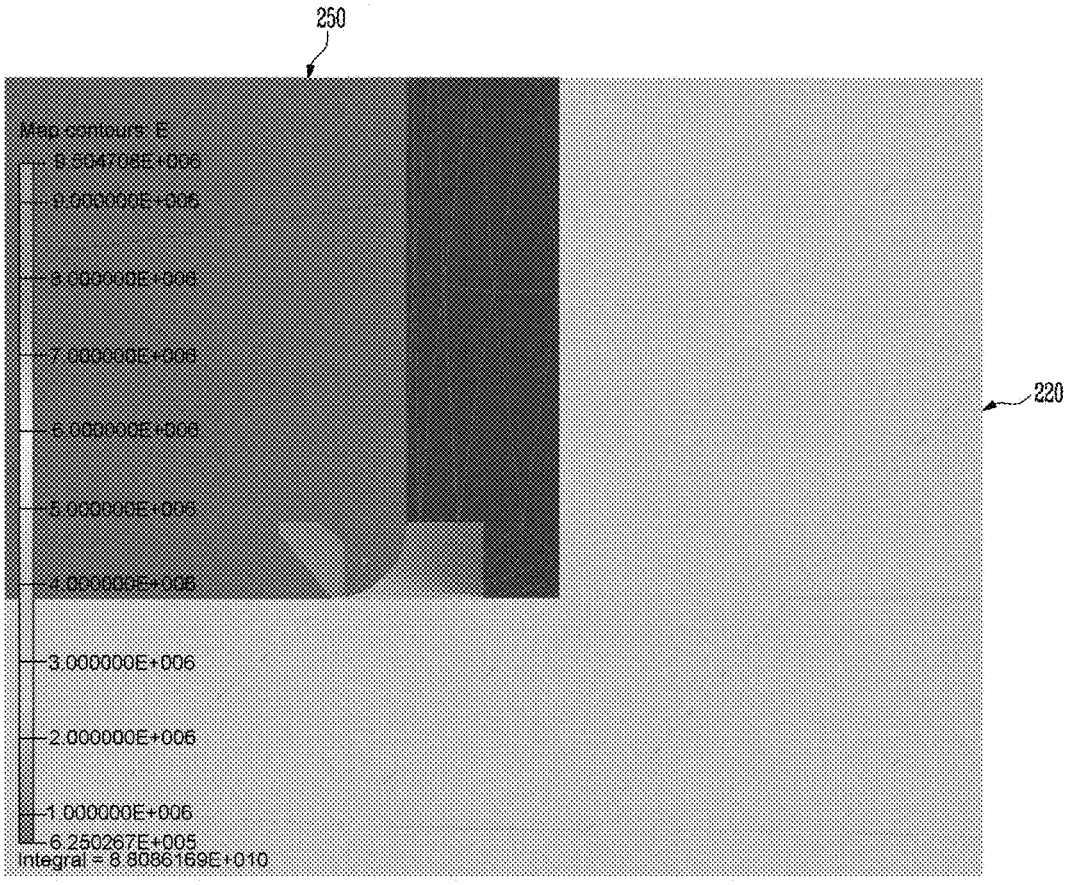
FIG. 7 illustrates an electric field at a portion B of the embodiment in FIG. 4

Now, FIG. 6 and FIG. 7 will be referenced to illustrate a joint field difference between the above embodiments in FIG. 2 and FIG. 4. As used herein, the "joint field" may refer to an electrical field generated at a joint location between the gate electrode and filter tube. Since the filter tube may be made of the alumina material, a field emission may occur at the joint location with the gate electrode. Such field emission has been measured as in FIG. 6 and FIG. 7.

FIG. 6 is a graph of a field emission at a joint location A in FIG. 2, specifically, a joint location between one end 156 of the filter tube and the other end 126 of gate electrode, while FIG. 7 is a graph of a field emission at a joint location B in FIG. 4, specifically, a joint location between one end 256 of the filter tube and one face 226 of the gate electrode flange. FIG. 6 and FIG. 7 shows field emission measurements respectively when both of the second electrodes 130, and 230 have a voltage 65 kV applied thereto, and both of the gate electrodes 120, and 220 may have a voltage 2.5 kV applied thereto.

With reference to FIG. 2 and FIG. 6, the field emission measurement at the joint A is approximately 11V/μm, whereas with reference to FIG. 4 and FIG. 7, the field emission measurement at the joint B is approximately 9.5V/μm. That is, the embodiment in FIG. 4 may have a smaller field emission than the embodiment in FIG. 2. This may come from the fact that in FIG. 4, the gate electrode 220 has the gate electrode flange 223 disposed between the insulation tube 140 and the filter tube 250, and the gate electrode body 222 is configured to extend along the hollow portion 251 of the filter tube toward the second electrode 230.

A reference will be made to FIG. 8 and FIG. 9, which illustrate field and potential distributions around the joint between the gate electrode 220 and filter tube 250 in FIG. 4. In this case, the second electrode 230 has a voltage 65 kV applied thereto, and the gate electrode 220 has a voltage 2.5 kV applied thereto. Referring to color bars at left sides of FIG. 8 and FIG. 9 respectively, different colors may refer to different levels of the field or potential. To be specific, as moving from an upper(red) color to a lower (blue) color, the field E or potential V decrease.

Figure 8:
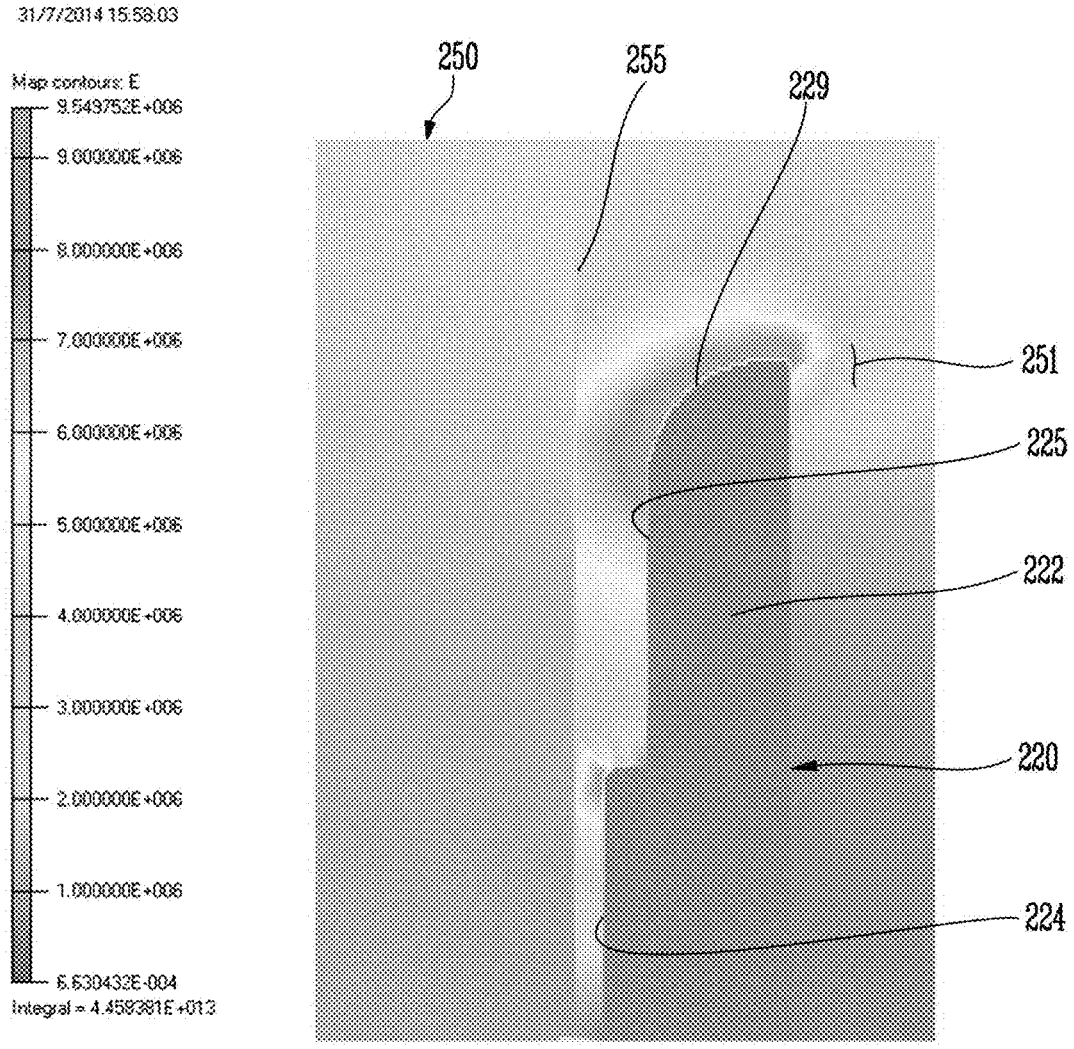
FIG. 8 illustrates an electric filed distribution of the embodiment in FIG. 5.

Referring to FIG. 8, in the embodiment of FIG. 4, the field distribution as measured may be configured such that the field around the free end 229 of the gate electrode is larger than around a joint location between the gate electrode 220 and the filter tube 250. For this reason, as addressed above, the rounded surface of the free end 229 of the gate electrode may lead to reduction of the field concentration thereto. A curvature of the free end 229 may be large sufficient to suppress concentration of the field into the gate electrode end 229.

Figure 9:
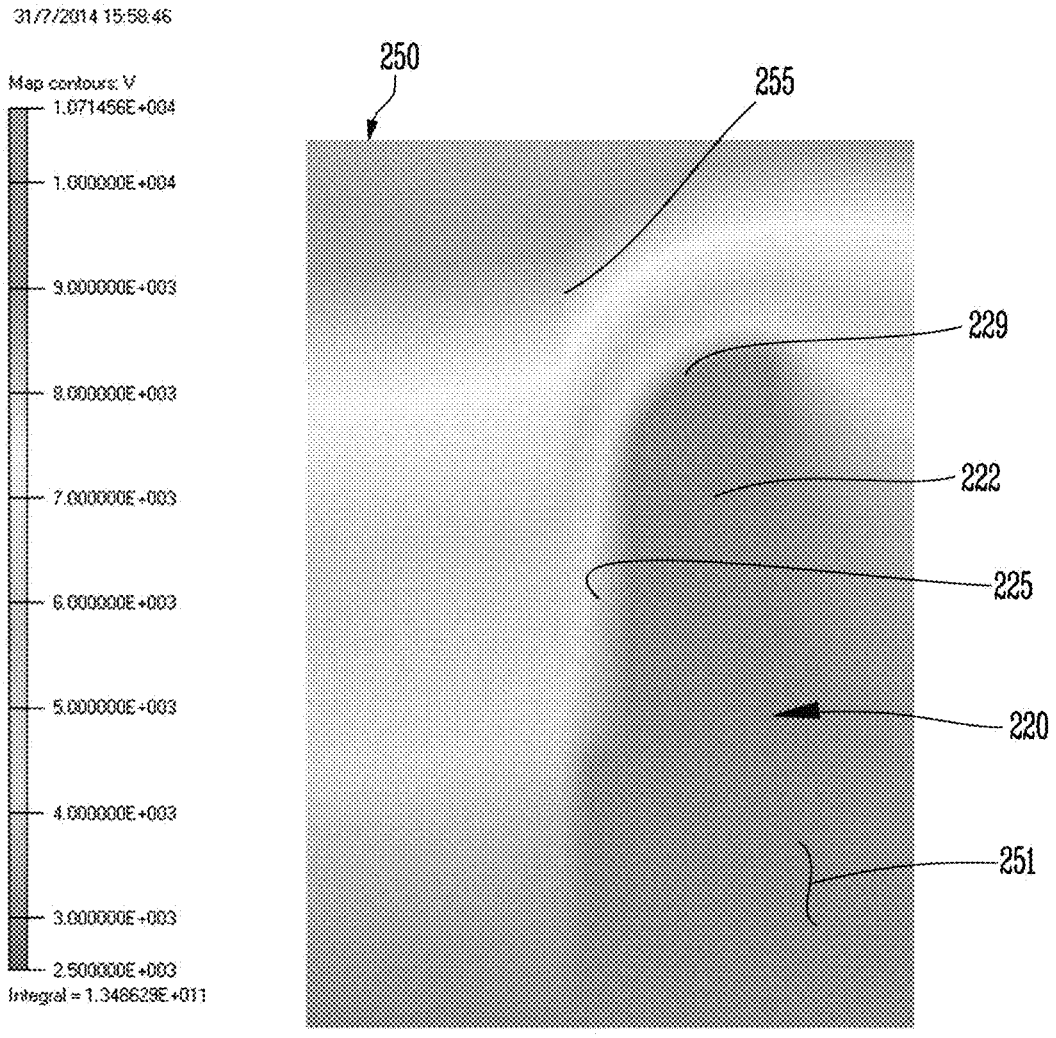
FIG. 9 illustrates a potential distribution of the embodiment in FIG. 5.

Referring to FIG. 9, in the embodiment of FIG. 4, as seen from the potential distribution as measured, although the field emission may occur at the joint between the gate electrode flange 223 and the filter tube 250, it may be difficult for the generated field to emit out of the joint between the gate electrode 120 and the filter tube 250. This is due to the structure of the gate electrode 220 in FIG. 4. Thus, this embodiment in FIG. 4 may result in a micro X-ray tube not being influenced by the field generated at the joint between the gate electrode and filter tube.

Figure 10:
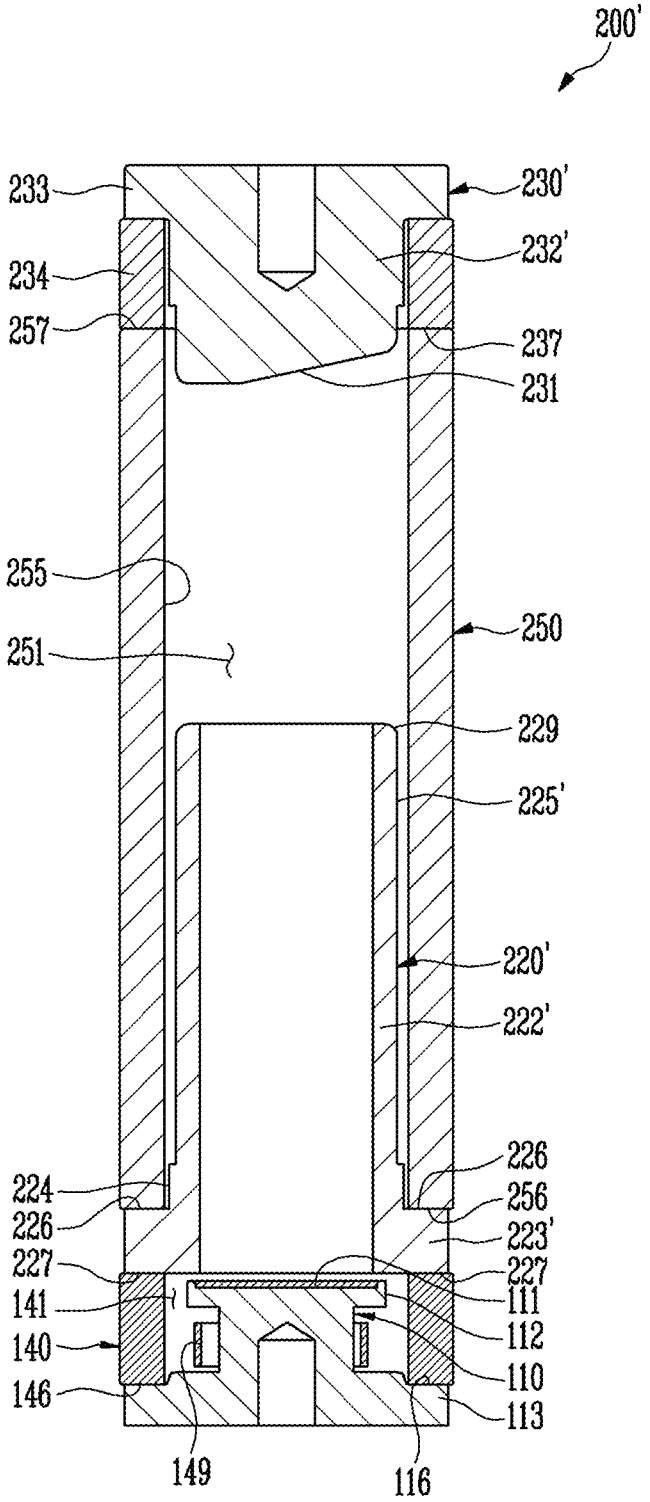
FIG. 10 is a cross-sectional view of another embodiment of the present disclosure.

FIG. 10 illustrates another embodiment with variations of the second electrode 230 and gate electrode 220. A micro X-ray tube 200' according to another embodiment may include a first electrode 110, a gate electrode 220', a second electrode 230', an insulation tube 140 to insulate between the first electrode and the gate electrode, and a filter tube 250 disposed between the second electrode and the gate electrode and filtering X-rays.

The first electrode 110 and the insulation tube 140 in this embodiment may be identical with those in the embodiment in FIG. 4. Thus, as indicated, the same labels are marked thereto as in FIG. 4. Further, detailed descriptions of the same may be omitted. Moreover, the filter tube 250 in this embodiment may be identical with those in the embodiment in FIG. 4. Thus, as indicated, the same labels are marked thereto as in FIG. 4. Further, detailed descriptions of the same may be omitted.

The gate electrode 220' may be an electrode tube with a hollow portion. The gate electrode 220' may have a gate electrode flange 223' secured between the insulation tube 140 and the filter tube 250, and a gate electrode body 222' configured to extend from the gate electrode flange 223' toward the second electrode 230' while being received in the hollow portion 251 of the filter tube. The hollow portion of the gate electrode 220' may pass through the gate electrode flange 223' and the gate electrode body 222'. Both opposing ends of the gate electrode 220' may open toward the first electrode 110 and the second electrode 230' respectively.

The gate electrode flange 223' may have formed of a relatively smaller longitudinal extension than in the flange 223 in FIG. 4.

The gate electrode flange 223' may have a first side 226 engaged with one end 256 of the filter tube, and a second side 227 engaged with the other end 147 of the insulation tube. It may be appreciated that the dimension of the gate electrode flange 223' may vary relative to those of other components including the filter tube.

The gate electrode body 222' may have, like the gate electrode body 222 in FIG. 5, first and second outer surface portions and middle outer surface portion therebetween. The first portion may extend from the gate electrode flange 223' toward the second electrode 230'. The middle portion may extend from the first point inwardly to the second portion. The second portion may extend from the middle portion to the end portion 229 of the gate electrode body.

It may be noted that a configuration difference of the gate electrode body 222' in FIG. 10 from the gate electrode body 222 in FIG. 4 may come from a longer longitudinal extension of the second portion 225' than that of the second portion 225 in FIG. 4. Accordingly, to achieve the same distance between the target of the second electrode and the free end (indicated by 229 in FIG. 4 and FIG. 10) of the gate electrode in both of the embodiments in FIG. 4 and FIG. 10, there may occur a variation of the longitudinal extension of the second electrode body. To be specific, the longer longitudinal extension the second portion of the gate electrode body 222' has, the smaller longitudinal extension the second electrode body 232' has.

The second electrode 230' may have the same configuration as the second electrode 230 in FIG. 4 except for the smaller longitudinal extension. For this reason, an upper prime symbol "'" is added to the same reference numeral. Thus, a rest of a configuration thereof may be omitted.

Via the longer longitudinal extension of the second portion 225' of the gate electrode body 222' in this embodiment, there may a decrease in a possibility of a field emission into between the filter tube and the gate electrode.

Furthermore, an increase in the pass-path of the electron-beams along and in the gate electrode in this embodiment in FIG. 10 may lead to a significant decrease in a possibility of collisions of the beams with the filter tube. The alumina may have a high secondary-electron emission coefficient and thus may generate secondary-electron emissions on collisions of the primary electron-beam with the filter tube. For this reason, via the larger longitudinal extension of the gate electrode as in FIG. 10, the possibility of the secondary-electron emissions may considerably reduce.

Figure 11:
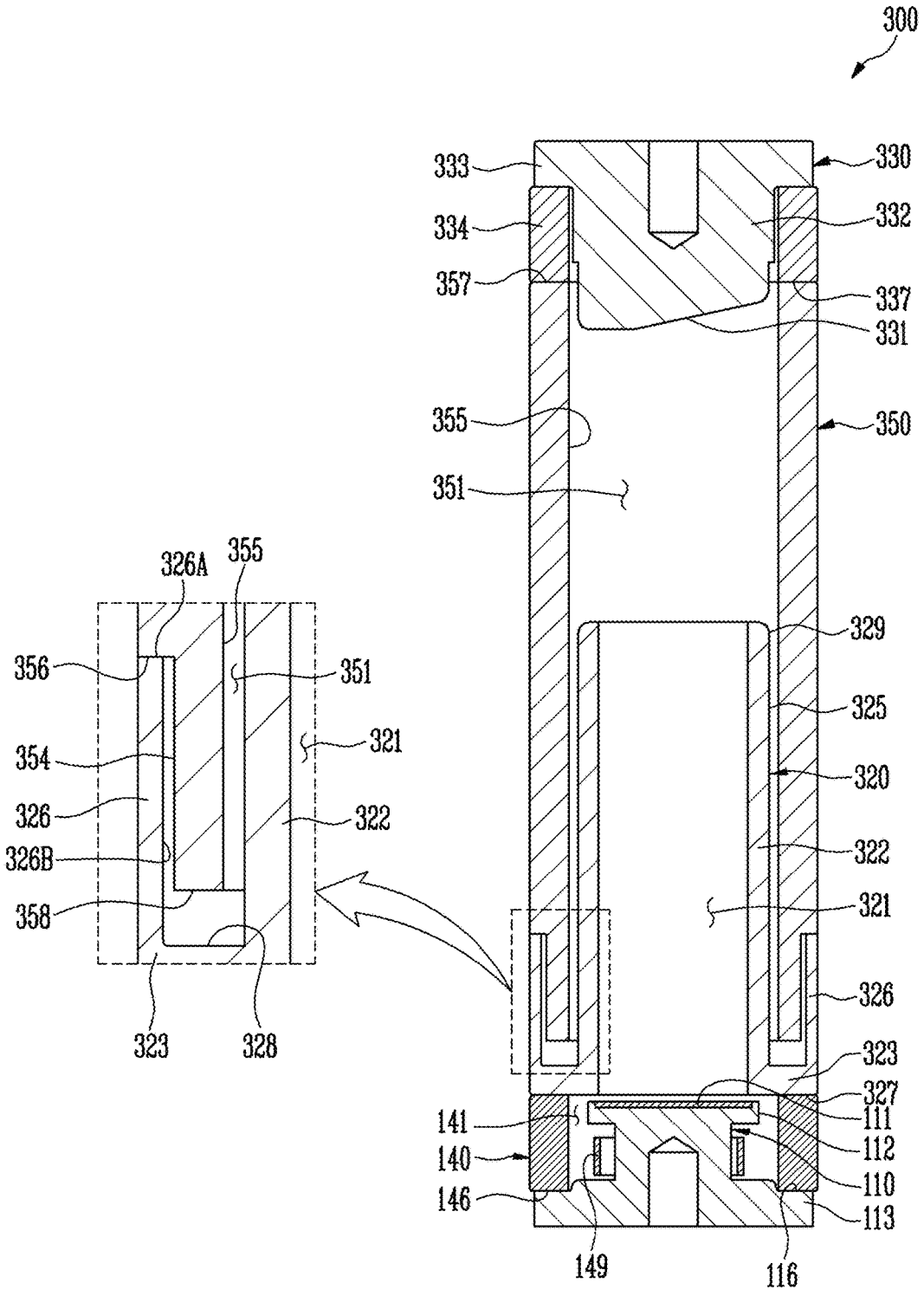
FIG. 11 is a cross-sectional view of another embodiment of the present disclosure.

FIG. 11 is a cross-sectional view of one embodiment of a micro X-ray tube in the present disclosure. The micro X-ray tube 300 in this embodiment may include a first electrode 110, a gate electrode 320, a second electrode 330, an insulation tube 140 to insulate between the first electrode and the gate electrode, and a filter tube 350 disposed between the second electrode and the gate electrode to filter X-rays.

The first electrode 110 and the insulation tube 140 in this embodiment may be identical with those in the embodiment in FIG. 2 and FIG. 4. Thus, as indicated, the same labels are marked thereto as in FIG. 4. Further, detailed descriptions of the same may be omitted.

The second electrode 330 may be formed in a generally cylindrical tube and may have a target 331 to be collided with electron-beams accelerated via the gate electrode 320. The second electrode 330 may include a second electrode flange 333 to secure the second electrode, and a second electrode body 332 extending from the second electrode flange 333 toward the gate electrode 320 through a hollow portion 351 of the filter tube 350.

The second electrode 330 may further include a conductive tube 334 having one end engaged with the second electrode flange 333 and the other end 337 engaged with the other end 357 of the filter tube 350. The conductive tube 334 may surround a portion of the second electrode body 332 and may have the same thickness and/or shape as the filter tube 350. The conductive tube 334 may be integral of the second electrode flange or may be omitted, as addressed above in connection with FIG. 2 or FIG. 4.

The second electrode body 332 may include a further extension to extend beyond the conductive tube 334 so that a portion including the target 331 may be received in the hollow portion 351 of the filter tube 350. The second electrode body 332 may have the target 331 at the end thereof facing the gate electrode 320. The target 331 may be spaced from the gate electrode 320.

The target 331 may have an inclined surface configured such that X-rays generated by collisions between the electron-beam and the target 331 may be directed to the filter tube 350. The X-rays may transmit the filter tube 350 and emit out of the X-ray tube.

The filter tube 350 may be disposed between the second electrode 330 and the gate electrode 320 to serve to filter the X-rays. The filter tube 350 may have an inner surface 355 to define the hollow portion 351 thereof. The hollow portion may receive the target 331. Further, the filter tube 350 may extend beyond the target 331 toward the gate electrode 320, to space the second electrode from the gate electrode. The filter tube may contain the alumina to filter the X-rays from the target 331.

The gate electrode 320 may be an electrode tube extending toward and being opened to the first electrode 110 and the second electrode 330. The gate electrode 320 may include a gate electrode flange 323 secured between the insulation tube 140 and the filter tube 350, and a gate electrode body 322 extending from the gate electrode flange toward the second electrode 330 through the hollow portion 351 of the filter tube.

The gate electrode 320 may have a hollow portion 321, which may run through all of the gate electrode flange 323 and the gate electrode body 322.

The gate electrode body 322 may be spaced from the filter tube 350. To be specific, one face 325 may face the inner surface 355 in a spaced manner therefrom. The end 329 of the gate electrode body may be disposed opposite to the gate electrode flange 323 in a longitudinal direction and may be formed in a rounded shape to suppress a field concentration thereto, as in the free end 229 of FIG. 4.

The filter tube 350 may have a step portion at one end thereof at an outer surface facing the gate electrode flange 323. The gate electrode flange 323 may have an extension wall 326 to be configured to contact with the step portion.

The step portion of the filter tube 350 may have a first surface 356 extending inwardly from an outer surface of the filter tube, and a second surface 354 extending from the first surface 356 toward the first electrode 110. The second surface may be referred to as a side surface. The side surface 354 may be surrounded with the extension wall 326 of the gate electrode flange. The side surface 354 may extend from the first surface 356 toward the free end 358 of the filter tube.

The free end 358 of the filter tube may be spaced from the gate electrode flange 323. Specifically, first side 328 of the gate electrode flange facing the free end 358 may be spaced from the end of the filter tube. The other end 357 of the filter tube may be engaged with one end 337 of the conductive tube 334. In an alternative embodiment where it dispenses with the conductive tube 334, the end 357 of the filter tube may be directly coupled to the second electrode flange 333.

The extension wall 326 may extend from the first side 328 of the gate electrode flange 323 toward the second electrode 330 and encounter the first surface 356 of the step portion. The extension wall may be formed generally in a ring shape. The extension wall 326 may extend in a longitudinal direction thereof beyond the side surface 354 of the step portion, to space the free end 358 of the filter tube from the gate electrode flange 323.

The extension wall 326 may have an inner surface 326B facing the side surface 354 of the step portion, and an end 326A engaged with the first surface 356 of the step portion. The inner surface 326B of the extension wall 326 may have a longer length than that of the side surface 354 of the step portion. The side surface 354 of the step portion may be spaced from the inner surface 326B of the extension wall 326.

The filter tube 350 may be disposed such that a portion thereof corresponding to and between the side surface 354 of the step portion and the free end 358 may be inserted between the gate electrode body 322 and the extension wall 326, while the first surface 356 of the step portion may be engaged with the end 326A of the extension wall.

In the above-addressed configuration in FIG. 11, a joint location between the filter tube 350 and the gate electrode 320 is outsides of the filter tube. In this approach, although the field emission may occur in the joint location, it may be difficult for the generated field to emit into between the inner surface 355 of the filter tube 350 and the gate electrode 320.

The above description is not to be taken in a limiting sense, but is made merely for the purpose of describing the general principles of exemplary embodiments, many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A micro X-ray tube, comprising:

a first electrode with an emitter emitting an electron-beam;

a gate electrode having a hollow portion provided therein as a path for the electron-beam from the first electrode, the gate electrode accelerating the electron-beam;

a second electrode with a target configured to collide with the accelerated beam;

an insulation tube configured to electrically insulate between the first electrode and the gate electrode; and a filter tube between the second electrode and the gate electrode thereby separating the second electrode from the gate electrode, the filter tube filtering X-rays, wherein the filter tube includes an alumina $Al_2O_3$, and the target is inclined so that the X-rays generated by collision between the target and the electron-beam are directed toward the filter tube, wherein the gate electrode comprises:

a gate electrode flange between the insulation tube and the filter tube, the gate electrode flange being engaged with the insulation tube and/or the filter tube; and a gate electrode body extending along inside the filter tube, and extending from the gate electrode flange toward the second electrode, wherein the filter tube includes a step portion engaged with the gate electrode flange.

2. The X-ray tube of claim 1, wherein the filter tube has an inner surface defining a hollow portion of the filter tube, wherein the target faces and inclines toward the inner surface of the filter tube.

3. The X-ray tube of claim 2, wherein the second electrode includes:

a flange; and a body extending from the flange toward the gate electrode, the body having the target at one end thereof, wherein the hollow portion of the filter tube receives at least a portion of the body.

4. The X-ray tube of claim 1, wherein the gate electrode is tube-shaped, and is secured between the insulation tube and the filter tube.

5. The X-ray tube of claim 1, wherein the insulation tube is between the gate electrode flange and the first electrode, and wherein the gate electrode flange is spaced apart from the first electrode.

6. The X-ray tube of claim 5, wherein the first electrode has an end where the emitter mounted on, wherein a diameter of the end of the first electrode is larger than a diameter of the hollow portion of the gate electrode but smaller than an inner diameter of the insulation tube.

7. The X-ray tube of claim 1, wherein the step portion of the filter tube includes:

a first surface extending inwardly from an outer surface of the filter tube; and a second surface extending in a longitudinal direction of the filter tube from the first surface toward the first electrode, the second surface meeting a free end of the filter tube, wherein the gate electrode flange contacts with the first surface.

8. The X-ray tube of claim 7, wherein the gate electrode flange has an extension wall extending from an outer circumference of the electrode flange toward the second electrode and surrounding the second surface of the step portion.

9. The X-ray tube of claim 8, wherein the extension wall contacts with the first surface of the step portion, and configured to be spaced from the second surface of the step portion and from the free end of the filter tube.

10. The X-ray tube of claim 1, wherein the gate electrode is tube-shaped and secured between the insulation tube and the filter tube.

11. The X-ray tube of claim 1, wherein the filter tube has an inner surface defining a hollow portion of the filter tube, wherein the gate electrode body has an outer surface facing and being spaced from the inner surface of the filter tube.

12. The X-ray tube of claim 11, wherein an outer surface of the gate electrode body has a step between a first body portion and the second body portion so that a spacing between the first body portion and the inner surface of the filter tube is smaller than a spacing between the second body portion and the inner surface of the filter tube.

13. The X-ray tube of claim 12, wherein the first body portion extends from the gate electrode flange toward the second electrode, wherein the second body portion connects with the first body portion via the step of the gate electrode body and extends toward the second electrode.

14. The X-ray tube of claim 12, wherein the hollow portion of the gate electrode have a single diameter in a longitudinal direction thereof, wherein the hollow portion runs through entirely the gate electrode flange, the first body portion and the second body portion.

15. The X-ray tube of claim 1, wherein the gate electrode body has a free end facing the second electrode, wherein the free end has a rounded surface.

16. A micro X-ray tube, comprising:

a first electrode with an emitter emitting an electron-beam;

a gate electrode having a hollow portion provided therein as a path for the electron-beam from the first electrode, the gate electrode accelerating the electron-beam;

a second electrode with a target configured to collide with the accelerated beam;

an insulation tube configured to electrically insulate between the first electrode and the gate electrode; and a filter tube between the second electrode and the gate electrode thereby separating the second electrode from the gate electrode, the filter tube filtering X-rays, wherein the filter tube includes an alumina $Al_2O_3$, and the target is inclined so that the X-rays generated by collision between the target and the electron-beam are directed toward the filter tube, wherein the gate electrode comprises:

a gate electrode flange between the insulation tube and the filter tube, the gate electrode flange being engaged with the insulation tube and/or the filter tube; and a gate electrode body extending along inside the filter tube, and extending from the gate electrode flange toward the second electrode, wherein the insulation tube is between the gate electrode flange and the first electrode, and wherein the gate electrode flange is spaced apart from the first electrode, and wherein the first electrode has an end where the emitter mounted on, wherein a diameter of the end of the first electrode is larger than a diameter of the hollow portion of the gate electrode but smaller than an inner diameter of the insulation tube.

17. A micro X-ray tube, comprising:

a first electrode with an emitter emitting an electron-beam;

a gate electrode having a hollow portion provided therein as a path for the electron-beam from the first electrode, the gate electrode accelerating the electron-beam;

a second electrode with a target configured to collide with the accelerated beam;

an insulation tube configured to electrically insulate between the first electrode and the gate electrode; and a filter tube between the second electrode and the gate electrode thereby separating the second electrode from the gate electrode, the filter tube filtering X-rays, wherein the filter tube includes an alumina $Al_2O_3$, and the target is inclined so that the X-rays generated by collision between the target and the electron-beam are directed toward the filter tube, wherein the gate electrode comprises:

a gate electrode flange between the insulation tube and the filter tube, the gate electrode flange being engaged with the insulation tube and/or the filter tube; and a gate electrode body extending along inside the filter tube, and extending from the gate electrode flange toward the second electrode, wherein the filter tube has an inner surface defining a hollow portion of the filter tube, wherein the gate electrode body has an outer surface facing and being spaced from the inner surface of the filter tube, wherein an outer surface of the gate electrode body has a step between a first body portion and the second body portion so that a spacing between the first body portion and the inner surface of the filter tube is smaller than a spacing between the second body portion and the inner surface of the filter tube, and wherein the first body portion extends from the gate electrode flange toward the second electrode, wherein the second body portion connects with the first body portion via the step of the gate electrode body and extends toward the second electrode.

* * * * *